US006224239B1

(12) United States Patent
Adler

(10) Patent No.: US 6,224,239 B1
(45) Date of Patent: May 1, 2001

(54) DECORATIVE LAMP FIXTURE WITH ICICLE SHAPE HAVING INTERIOR WITH PLURALITY OF VERTICALLY-SPACED LIGHTS

(75) Inventor: Howard Adler, Scarsdale, NY (US)

(73) Assignee: Kurt S. Adler, Inc., New York, NY (US)

( * ) Notice: Subject to any disclaimer, the term of this patent is extended or adjusted under 35 U.S.C. 154(b) by 0 days.

(21) Appl. No.: 09/293,753

(22) Filed: Apr. 16, 1999

(51) Int. Cl.[7] ..... F21V 21/00

(52) U.S. Cl. ..... 362/252; 362/252; 362/806; 362/249; 362/227; 362/240

(58) Field of Search ..... 362/252, 806, 362/249, 227, 240

(56) References Cited

U.S. PATENT DOCUMENTS

| | | | | |
|---|---|---|---|---|
| D. 203,507 | | 1/1966 | Richardson | D11/125 |
| D. 225,369 | | 12/1972 | Miller | D11/125 |
| D. 386,445 | | 11/1997 | Odierna | D11/121 |
| 2,042,905 | | 6/1936 | McCluskey | 428/7 |
| 2,067,018 | | 1/1937 | Pretzfelder | 362/341 |
| 2,297,191 | * | 9/1942 | Parman | 248/524 |
| 2,513,565 | | 7/1950 | Johnson | 362/332 |
| 2,554,363 | | 5/1951 | Glaser et al. | 428/7 |
| 2,821,802 | | 2/1958 | Glaser | 428/7 |
| 3,704,365 | * | 11/1972 | Miller | 362/294 |
| 5,057,981 | | 10/1991 | Bowen et al. | 362/219 |
| 5,150,964 | | 9/1992 | Tsui | 362/251 |
| 5,645,343 | * | 7/1997 | Rinehimer | 362/238 |
| 5,685,635 | | 11/1997 | Barthelmess | 362/249 |
| 5,700,081 | | 12/1997 | Mengle et al. | 362/123 |
| 5,918,967 | * | 7/1999 | Land | 362/255 |
| 6,033,088 | * | 3/2000 | Contigiani | 362/249 |

* cited by examiner

*Primary Examiner*—Sandra O'Shea
*Assistant Examiner*—Anabel M. Ton
(74) *Attorney, Agent, or Firm*—Cooper & Dunham LLP

(57) ABSTRACT

A decorative light structure having a plurality of lights electrically connected for hanging along a power wire, the lights fixed at vertically spaced intervals inside a case enclosing the lights.

11 Claims, 3 Drawing Sheets

DECORATIVE LAMP FIXTURE WITH ICICLE SHAPE HAVING INTERIOR WITH PLURALITY OF VERTICALLY-SPACED LIGHTS

FIELD OF THE INVENTION

This invention relates to decorative light displays, and more particularly, to decorative light displays having one or more hanging light enclosures, each enclosure having a plurality of lights electrically connected to a power wire and fixed at respective vertically spaced intervals on the inner surface of the enclosure encasing the lights so as to illuminate the length of the enclosure.

BACKGROUND OF THE INVENTION

Various conventional devices for displaying hanging lights are known, for example, Christmas tree ornaments which allow for insertion of a single standard tree light, see U.S. Pat. No. 2,042,905 to McCluskey and U.S. Pat. No. 2,067,018 to Pretzfelder. Also, an external frame for supporting standard strings of lights are known, see U.S. Pat. No. Des. 386,445 to Odierna.

None of these devices, however, provide an enclosure for a plurality of lights arranged at respective vertically spaced intervals along a hanging enclosure.

SUMMARY OF THE INVENTION

An object of the present invention is to provide a decorative light display which allows a plurality of lights to be housed inside of a case or enclosure.

A further object is to provide means for mounting the lights at vertically spaced intervals within the case or enclosure.

One object of the invention is to provide a decorative light structure having a power wire including one or more electrical connectors; a plurality of lights electrically connected and arranged in one or more groups at spaced intervals along the power wire; and at least one case for enclosing the lights. The case has an inner surface and an outer surface and the lights of one group are fixed at vertically spaced intervals to respective light holders formed on the inner surface of the case. The case can be formed from two symmetric half parts and the outer surface can be formed to simulate an icicle. Also, each case can be formed to hang down from a portion of the power wire.

Another object of the invention is to provide a decorative light structure wherein each light holder has a first arm spaced from a second arm and a spacer formed between the first arm and the second arm, the spacer abutting at least a part of the light to prevent the illuminating part of the light from touching the inner surface of the case.

An additional object of the invention is to provide a decorative light structure having power wire means including electrical connecting means; lighting means electrically connected and arranged in one or more groups at spaced intervals along the power wire means; and encasing means having an inner surface and an outer surface, the lighting means of one group being fixed at vertically spaced intervals to light holding means located in the inner surface of the encasing means.

Also, an object of the present invention is to provide a decorative light case to retain a plurality of lights having a base and an illuminating part, the decorative light case having a first case part having connectors which attach to complementary connectors of a second case part, each case part having an interior portion and an exterior portion; a cap which fits over one end of the case; and a plurality of light holders formed along the interior portion, each light holder having a brace provided as a pair of arms, the arms being spaced apart approximately the diameter of one of the light bases to engage the base, and a spacer formed between the arms to prevent the illuminating part of a light from touching the interior portion of the case part. The cap can have an opening for allowing passage of a power supply wire into and out of the case. Also, the light holders can be spaced at vertical intervals along the length of the case to provide even lighting along the decorative light case.

BRIEF DESCRIPTION OF THE DRAWINGS

The features and advantages of the invention will become apparent upon review of the following detailed description of preferred embodiments, taken in conjunction with the following drawings, in which.

DETAILED DESCRIPTION OF THE PREFERRED EMBODIMENTS

Figure 1:
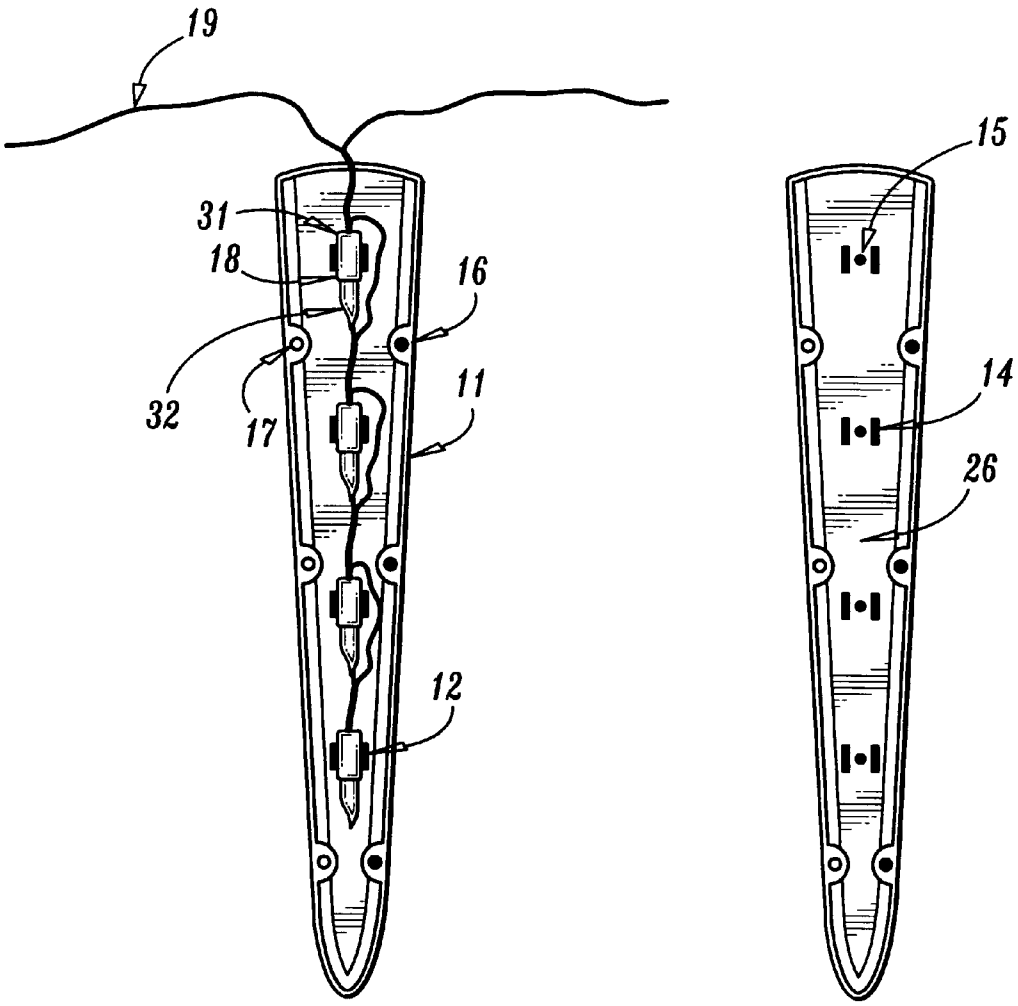
FIG. 1 is a view of the interior of two case parts according to an embodiment of the present invention.
Figure 2:
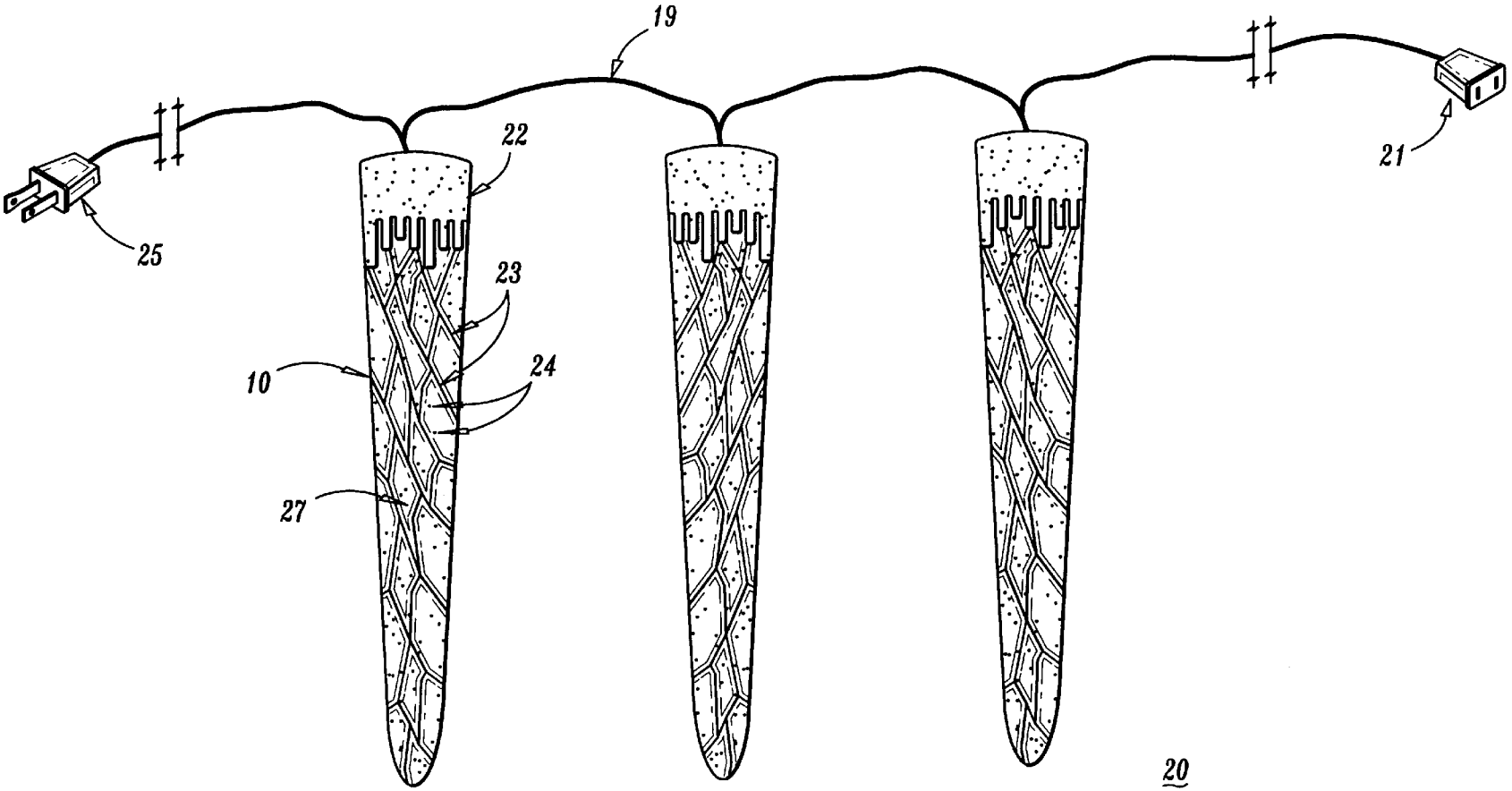
FIG. 2 is a view of a decorative light structure according to an embodiment of the present invention having a plurality of cases.
Figure 3:
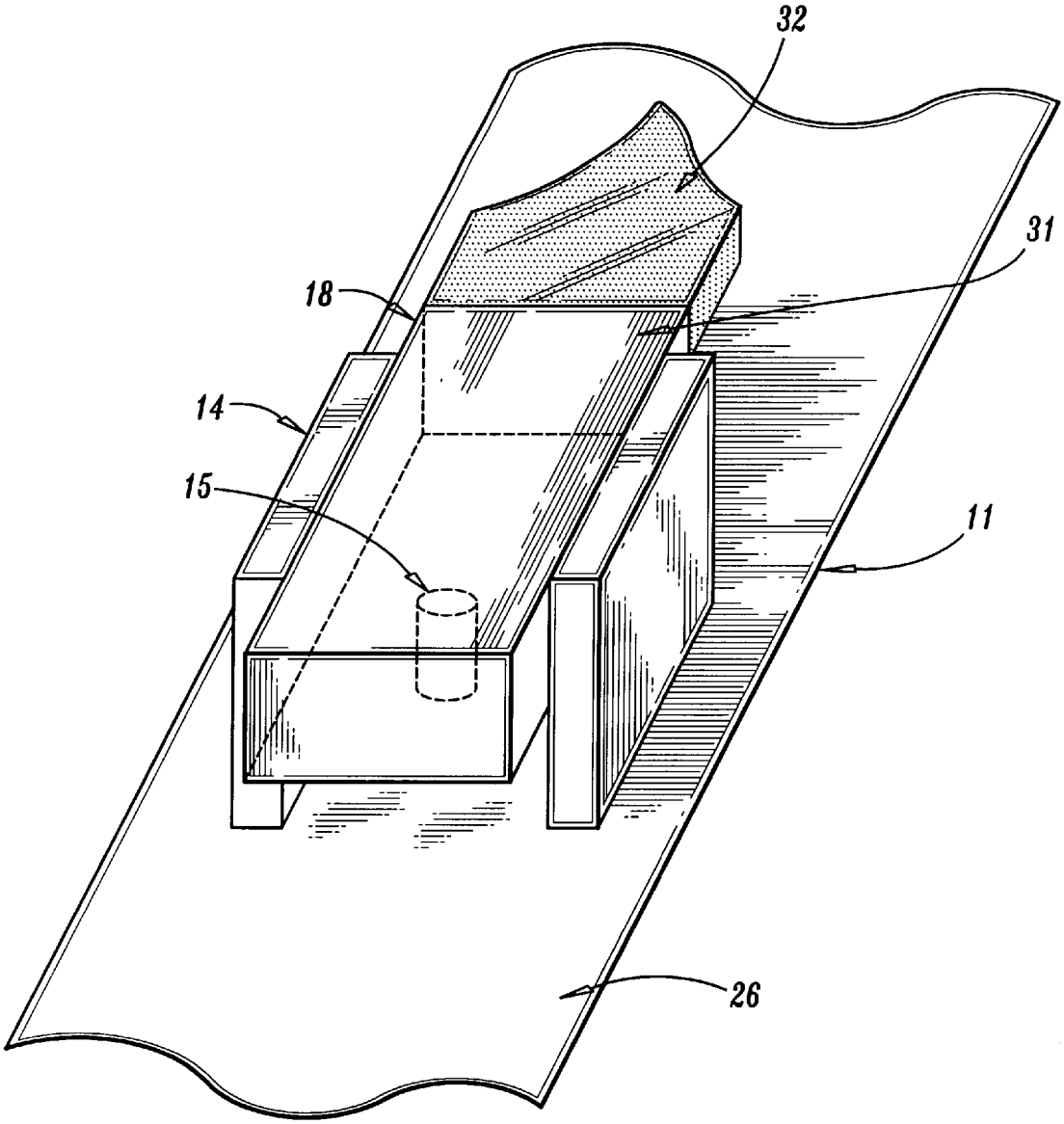
FIG. 3 is a view of a light holder according to an embodiment of the present invention.

As shown in FIGS. 1 and 2, the present invention relates to a decorative light structure 20 comprising a power wire 19 having a male electrical connector 25 and a female electrical connector 21; lights 18 arranged at spaced intervals along the wire 19 in series or parallel; and at least one case 10. The power wire 19, in one embodiment, is a twisted pair.

Each case 10 is formed in the shape of an inverted cone so as to resemble an icicle. In one embodiment of the present invention, the case 10 has two symmetric half parts 11. The interior of each half part 11 includes a series of light holders 12 arranged at vertically spaced intervals along the inner surface 26 of the half part 11. The lights 18 are respectively fixed in the light holders 12 to form a vertical column of lights 18 in each case 10. The vertical column of lights 18 provides lighting along the entire length of the case 10.

A light holder 12 includes two arms 14 spaced apart from each other a distance sufficient to allow a light 18 to become removably attached between the arms 14. In one embodiment of the present invention, the arms 14 are rectangular in shape. A spacer 15 is located at the center of each light holder 12. The spacer 15 is provided to abut the side of the base 31 of a light 18, and thereby, prevent the illuminating portion 32 of the light 18 from touching the inner surface 26 of the case 10. In one embodiment of the present invention, each spacer 15 is a short cylinder molded to the inner surface 26 of the half part 11.

Each half part 11 also includes pegs 16 and receptacles 17 at respective opposite sides of the half part 11 and fixed at vertically spaced intervals along the sides of the half part 11. When the case 10 is closed, each receptacle 17 receives the peg 16 with which the receptacle 17 is aligned. The case 10, pegs 16, the receptacles 17, and the light holders 12, in one embodiment, are formed from lightweight material, such as a plastic material, and can be molded to the inner surface 26 as part of the half parts 11.

The outer surface 27 of a case 10, can in one embodiment, include ridges 23 to create a rough or chiseled appearance.

In addition, the case 10 can include glitter 24 sprinkled over the outer surface 27 to cause the case 10 to sparkle when the lights 18 are turned on. The case 10 is translucent to allow the light rays from the lights 18 to be seen through the case 10. In one embodiment, the case 10 includes a separate white cap portion 22 located at the top of the case 10 so as to resemble snow.

As shown in FIG. 2, each decorative light structure 20 may include more than one case 10 suspended like icicles in the downward vertical direction from the wire 19. Each case 10 may be located at horizontally spaced intervals along the wire 19, the wire 19 passing into and out of a hole in the cap 22.

While this invention has been described in terms of specific embodiments, this invention, including this disclosure and appended claims, is not so limited and is to be construed in accordance with the full spirit and scope of the invention including alternatives and modifications made apparent to those of skill in the art.

What is claimed is:

1. A decorative light structure, comprising:

a power wire including one or more electrical connectors;

a plurality of lights electrically connected and arranged in one or more groups at spaced intervals along the power wire; and at least one case having an open end, a closed end, an inner surface and an outer surface, the open end, closed end, and inner surface defining an interior space, the lights of one group fixed at vertically spaced intervals to respective light holders and located within the interior space of the case, each light holder comprising a brace provided as a pair of arms, the arms being spaced apart approximately a distance sufficient to engage a respective base of a respective light of the lights of the one group.

2. The decorative light structure according to claim 1, wherein the case hangs down from a portion of the power wire.

3. The decorative light structure according to claim 1, wherein the case is formed in a shape of an icicle.

4. The decorative light structure according to claim 1, wherein the case is formed as two symmetric half parts.

5. The decorative light structure according to claim 1, wherein each light holder includes:

a spacer formed between the pair of arms; the spacer abutting at least a part of the respective base to prevent the respective light from touching the inner surface.

6. A decorative light structure, comprising:

power wire means including electrical connecting means;

lighting means electrically connected and arranged in one or more groups at spaced intervals along the power wire means; and encasing means having a open end, a closed end, an inner surface and an outer surface, the open end, the closed end, and the inner surface defining an interior space, the lighting means of one group fixed at vertically spaced intervals to light holding means and located in the interior space of the encasing means.

7. A decorative light case for retaining a plurality of lights, each light having a base and an illuminating part, the decorative light case comprising:

at least two case parts, a first case part having connectors for attaching to complementary connectors of a second case part, each case part having an interior portion and an exterior portion;

a cap for fitting over one end of the case; and a plurality of light holders formed along the interior portion of at least one of the case parts, each light holder comprising a brace provided as a pair of arms, the arms being spaced apart approximately a distance sufficient to engage a respective base, and a spacer formed between the arms for preventing a respective illuminating part of a respective light of the plurality of lights from touching the interior portion of at least one of the case parts.

8. The decorative light case according to claim 7, wherein the cap comprises an opening for allowing passage of a power supply wire into and out of the case.

9. The decorative light case according to claim 7, wherein the light holders are spaced at vertical intervals along a length of the case for providing even lighting along the case.

10. The decorative light structure according to claim 1, further comprising:

a cap for fitting over the open end of the case.

11. The decorative light structure according to claim 10, wherein the cap further comprises an opening for allowing passage of the power wire into and out of the case.

* * * * *